US011085622B1

(12) United States Patent
Huang et al.

(10) Patent No.: US 11,085,622 B1
(45) Date of Patent: Aug. 10, 2021

(54) LIGHTING APPARATUS

(71) Applicant: XIAMEN LEEDARSON LIGHTING CO.LTD, Fujian (CN)

(72) Inventors: Zhenkun Huang, Fujian (CN); Shouqiang Hou, Fujian (CN); Xiaoliang Wen, Fujian (CN); Yongdun Ma, Fujian (CN); Yongzhe Dong, Fujian (CN)

(73) Assignee: XIAMEN LEEDARSON LIGHTING CO. LTD, Xiamen (CN)

( * ) Notice: Subject to any disclaimer, the term of this patent is extended or adjusted under 35 U.S.C. 154(b) by 0 days.

(21) Appl. No.: 16/941,201

(22) Filed: Jul. 28, 2020

(51) Int. Cl.

| | |
|---|---|
| ***F21V 23/04*** | (2006.01) |
| ***F21V 23/00*** | (2015.01) |
| ***F21S 8/02*** | (2006.01) |
| ***F21V 23/06*** | (2006.01) |
| ***F21Y 115/10*** | (2016.01) |

(52) U.S. Cl.
CPC ..... *F21V 23/04* (2013.01); *F21S 8/026* (2013.01); *F21V 23/009* (2013.01); *F21V 23/06* (2013.01); *F21Y 2115/10* (2016.08)

(58) Field of Classification Search
CPC ..... F21V 23/04; F21S 8/026; H01H 27/06; H01H 27/00; H01H 27/10; E05B 49/004; E05B 49/006
See application file for complete search history.

(56) References Cited

U.S. PATENT DOCUMENTS

| | | | | |
|---|---|---|---|---|
| 9,657,928 | B1 * | 5/2017 | Jacobson | H05B 45/00 |
| 9,801,250 | B1 * | 10/2017 | Halliwell | H05B 45/10 |
| 10,104,742 | B2 * | 10/2018 | Halliwell | F21K 9/65 |
| 10,433,390 | B2 * | 10/2019 | Halliwell | F21V 23/04 |
| 10,683,969 | B2 * | 6/2020 | Jeswani | F21K 9/278 |
| 2002/0071279 | A1 * | 6/2002 | Katogi | H05B 45/20 362/317 |
| 2005/0270780 | A1 * | 12/2005 | Zhang | F21V 29/77 362/257 |
| 2013/0163243 | A1 * | 6/2013 | Reed | H05B 45/382 362/235 |
| 2018/0206305 | A1 * | 7/2018 | Van Winkle | F21V 19/002 |
| 2018/0288847 | A1 * | 10/2018 | Halliwell | F21V 23/04 |
| 2019/0203893 | A1 * | 7/2019 | Ye | F21V 23/04 |
| 2019/0373701 | A1 * | 12/2019 | Halliwell | F21V 3/00 |

* cited by examiner

*Primary Examiner* — William N Harris
(74) *Attorney, Agent, or Firm* — Chun-Ming Shih; Lanway IPR Services

(57) ABSTRACT

A lighting apparatus includes a light source, a driver and a manual switch. The light source includes multiple LED modules. The driver includes a converter circuit and a control circuit. The converter circuit converts an external power source to a driving current supplied to the light source. The manual switch includes a socket and a plug for a user to insert the plug into the socket for selecting a working parameter. The manual switch is connected to the driver and the control circuit of the driver controls the light source according to the working parameter.

19 Claims, 9 Drawing Sheets

LIGHTING APPARATUS

FIELD

The present application is related to a lighting apparatus and more particularly related to a lighting apparatus with flexible configuration.

BACKGROUND

The time when the darkness is being lighten up by the light, human have noticed the need of lighting up this planet. Light has become one of the necessities we live with through the day and the night. During the darkness after sunset, there is no natural light, and human have been finding ways to light up the darkness with artificial light. From a torch, candles to the light we have nowadays, the use of light have been changed through decades and the development of lighting continues on.

Early human found the control of fire which is a turning point of the human history. Fire provides light to bright up the darkness that have allowed human activities to continue into the darker and colder hour of the hour after sunset. Fire gives human beings the first form of light and heat to cook food, make tools, have heat to live through cold winter and lighting to see in the dark.

Lighting is now not to be limited just for providing the light we need, but it is also for setting up the mood and atmosphere being created for an area. Proper lighting for an area needs a good combination of daylight conditions and artificial lights. There are many ways to improve lighting in a better cost and energy saving. LED lighting, a solid-state lamp that uses light-emitting diodes as the source of light, is a solution when it comes to energy-efficient lighting. LED lighting provides lower cost, energy saving and longer life span.

The major use of the light emitting diodes is for illumination. The light emitting diodes is recently used in light bulb, light strip or light tube for a longer lifetime and a lower energy consumption of the light. The light emitting diodes shows a new type of illumination which brings more convenience to our lives. Nowadays, light emitting diode light may be often seen in the market with various forms and affordable prices.

After the invention of LEDs, the neon indicator and incandescent lamps are gradually replaced. However, the cost of initial commercial LEDs was extremely high, making them rare to be applied for practical use. Also, LEDs only illuminated red light at early stage. The brightness of the light only could be used as indicator for it was too dark to illuminate an area. Unlike modern LEDs which are bound in transparent plastic cases, LEDs in early stage were packed in metal cases.

In 1878, Thomas Edison tried to make a usable light bulb after experimenting different materials. In November 1879, Edison filed a patent for an electric lamp with a carbon filament and keep testing to find the perfect filament for his light bulb. The highest melting point of any chemical element, tungsten, was known by Edison to be an excellent material for light bulb filaments, but the machinery needed to produce super-fine tungsten wire was not available in the late 19th century. Tungsten is still the primary material used in incandescent bulb filaments today.

Early candles were made in China in about 200 BC from whale fat and rice paper wick. They were made from other materials through time, like tallow, spermaceti, colza oil and beeswax until the discovery of paraffin wax which made production of candles cheap and affordable to everyone. Wick was also improved over time that made from paper, cotton, hemp and flax with different times and ways of burning. Although not a major light source now, candles are still here as decorative items and a light source in emergency situations. They are used for celebrations such as birthdays, religious rituals, for making atmosphere and as a decor.

Illumination has been improved throughout the times. Even now, the lighting device we used today are still being improved. From the illumination of the sun to the time when human can control fire for providing illumination which changed human history, we have been improving the lighting source for a better efficiency and sense. From the invention of candle, gas lamp, electric carbon arc lamp, kerosene lamp, light bulb, fluorescent lamp to LED lamp, the improvement of illumination shows the necessity of light in human lives.

Setting is always an important feature for a lighting apparatus. When lighting devices provide more functions, it is difficult to provide a convenient setting interface which has low cost, and reliable. Therefore, it is important to provide a flexible design on setting a parameter for various lighting devices.

SUMMARY

In some embodiments, a lighting apparatus includes a light source, a driver and a manual switch.

The light source includes multiple LED modules. The driver includes a converter circuit and a control circuit. The converter circuit converts an external power source to a driving current supplied to the light source. The manual switch includes a socket and a plug for a user to insert the plug into the socket for selecting a working parameter. The manual switch is connected to the driver and the control circuit of the driver controls the light source according to the working parameter.

The working parameter may include, but not limited to, a color temperature, a color, an intensity, a projection distance, a system setting mode or other working settings for the lighting apparatus.

In some embodiments, multiple inserting angles of the plug with respect to the socket correspond to multiple working parameters.

In some embodiments, a first inserting angle of the plug with respect to the socket activates a function of the driver and a second inserting angle of the plug with respect to the socket deactivates the function of the driver. The plug is still inserted to the socket to prevent dust no matter the function is activated or not.

In some embodiments, multiple inserting depths of the plug into the socket correspond to multiple working parameters.

In some embodiments, the plug has a configurable setting for changing the working parameter.

In some embodiments, the plug has a movable protruding block for triggering a structure setting while the plug is inserted into the socket to indicate the control circuit the working parameter.

In some embodiments, the plug has a plug switch for a user to select an option to change the working parameter.

In some embodiments, multiple plugs are provided to be selected inserting into the socket for selecting different working parameters.

In some embodiments, the plug has a pulling handle.

In some embodiments, the plug has a magnet unit sending a magnetic message to the socket to indicate the working parameter.

In some embodiments, the plug has a conductive unit for changing a circuit route of the driver when the plug is inserted into the socket.

In some embodiments, the plug is an elongated plate.

In some embodiments, the elongated plate has a terminal to change a conductive status of a switch disposed on the socket.

In some embodiments, when the elongated plate is pulled, the working parameter is set.

In some embodiments, the plug is movable to change the working parameter when the plug is inserted into the socket.

In some embodiments, the plug has a plug circuit to be integrated with the driver when the plug is inserted into the socket.

In some embodiments, the plug circuit works differently in response to a different socket message from the socket.

In some embodiments, the light source includes multiple LED types with multiple optical parameters. The driver controls the multiple LED types to mix a target optical parameter associated with the setting.

In some embodiments, the lighting apparatus may also include a light housing and a driver box, the light housing having a light holder and a surface rim. The light holder is mounted with the light source emitting a light from a light opening of the surface rim. The driver box stores the driver and exposing the socket on a surface.

In some embodiments, the driver box is mounted on a back side of the light holder and the driver box has an IDEAL socket for connecting to an IDEAL wire plug for receiving the external power source. A housing of the IDEAL socket is directly mounted on a driver plate. The IDEAL wire plug is a popular and well-known plug structure used for connecting wires. But, the IDEAL socket is not designed to be directly placed on the driver plate. Instead, the IEDAL socket mentioned here is made as an independent wire plug. With such design, the cost is further reduced while keeping a great compliance of known technology, thus bringing unexpected result.

DETAILED DESCRIPTION

Figure 10:
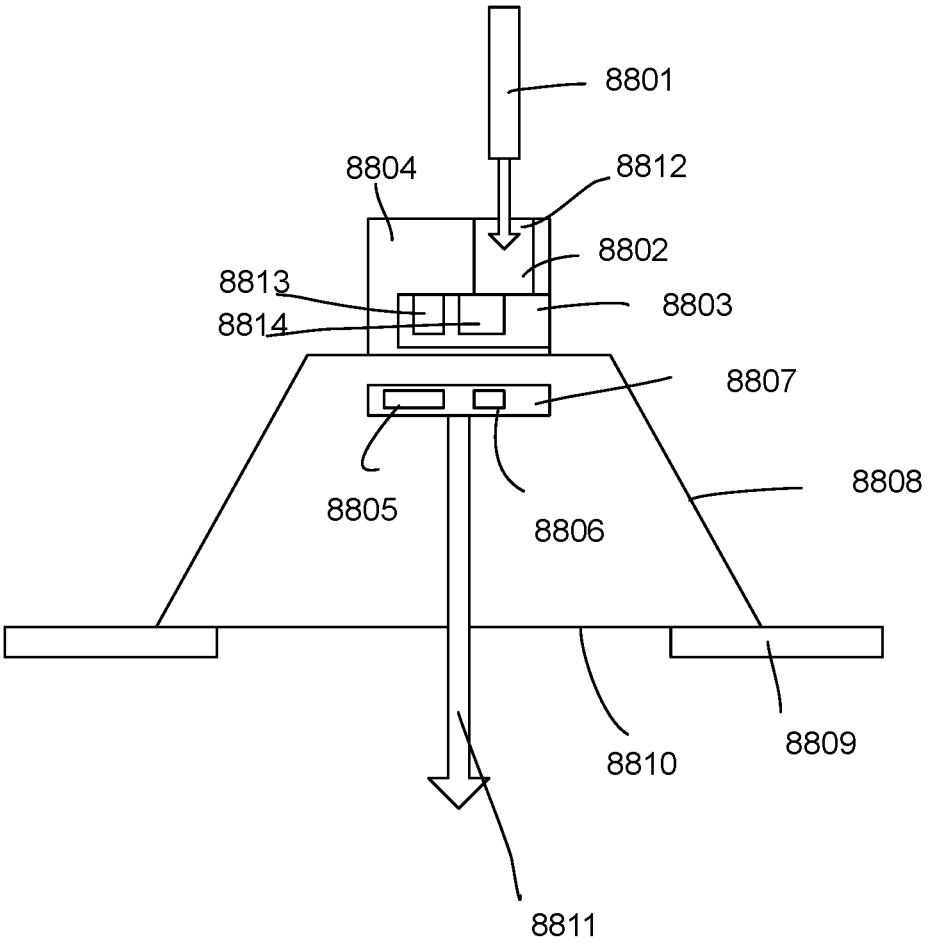
FIG. 10 shows a structural view of a lighting apparatus example.

In FIG. 10, a lighting apparatus includes a light source 8807, a driver 8803 and a manual switch 8812.

The light source 8807 includes multiple LED modules. The LED modules may have different types 8805, 8806. The LED modules may be controlled to mix desired color temperature, light intensity, color or other optical parameters.

In this example, the lighting apparatus is a downlight apparatus. The downlight apparatus has a light housing. The light housing includes a light holder 8808 and a surface rim 8809. The surface rim 8809 has a light opening 8810 for a light 8811 emitted from the light source 8807 to escape. The driver 8803 is placed in a driver box 8804. The driver box 8804 is mounted on a back cover of the light holder 8808.

The driver 8803 includes a converter circuit 8813 and a control circuit 8814.

The converter circuit 8813 converts an external power source to a driving current supplied to the light source 8807. The manual switch 8812 includes a socket 8802 and a plug 8801 for a user to insert the plug 8801 into the socket 8802 for selecting a working parameter.

The manual switch 8812 is connected to the driver 8803 and the control circuit 88014 of the driver 8803 controls the light source 8807 according to the working parameter.

In some other embodiments, the light holder may be an elongated tube and the light source may be a light strip installed in the light holder that has light passing cover to light to pass through. Such arrangement corresponds to a standard light tube apparatus. The manual switch may be placed at one end or a back side of the light tube apparatus.

In some other embodiments, the concept may be applied to a light bulb or a panel light. The manual switch is also added for indicating the driver to change a requested working parameter.

The working parameter may refer to a set of parameters, not necessary to be only a single parameter.

The working parameter may include, but not limited to, a color temperature, a color, an intensity, a projection distance, a system setting mode or other working settings for the lighting apparatus.

Figure 11A:
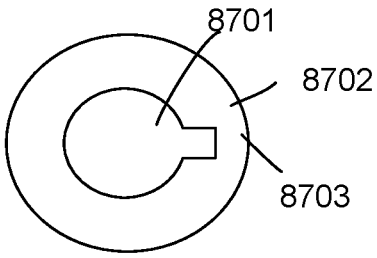
FIG. 11A, FIG. 11B and FIG. 11C show a manual switch having different angles for plugging.
Figure 11B:
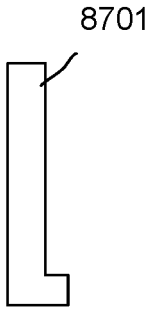
Figure 11C:
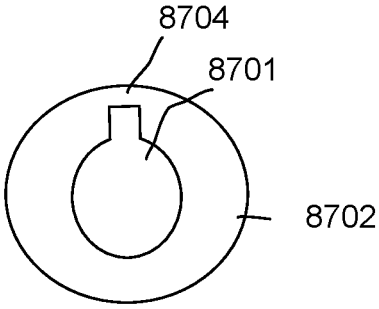

In FIG. 11A, FIG. 11B, and FIG. 11C, multiple inserting angles of the plug 8701 with respect to the socket 8702 correspond to multiple working parameters. Specifically, the plug 8701 may have a visible structure like a block which indicates a direction of the plug 8701. In FIG. 11A, the plug 8701 is inserted to the socket 8702 in a first angle 8703, which causes the driver to select a first working parameter. In FIG. 11C, the plug 8701 is inserted to the socket 8002 with a second angle 8704, which causes the driver to select a second working parameter. FIG. 11A and FIG. 11C show two insertion angles. FIG. 11B shows a side view of the plug 8701.

In some embodiments, a first inserting angle of the plug with respect to the socket activates a function of the driver and a second inserting angle of the plug with respect to the socket deactivates the function of the driver. The plug is still inserted to the socket to prevent dust no matter the function is activated or not.

Figure 12A:
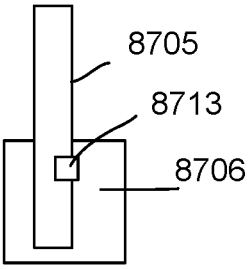
FIG. 12A and FIG. 12B show a manual switch with different depths for plugging.
Figure 12B:
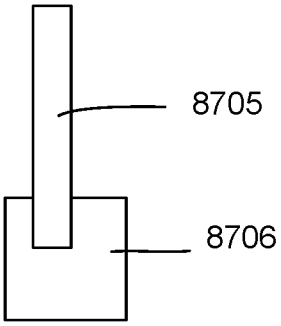

In FIG. 12A and FIG. 12B, multiple inserting depths of the plug 8705 into the socket 8706 correspond to multiple working parameters.

In some embodiments, the plug has a configurable setting for changing the working parameter.

Figure 13:
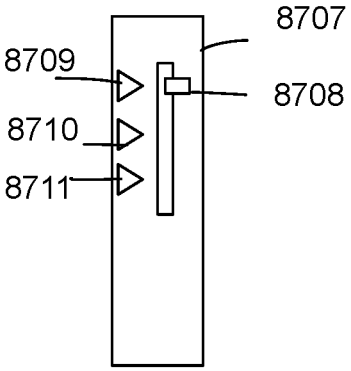
FIG. 13 shows another manual switch.

In FIG. 13, as an example, the plug 8707 has a plug switch 8708, which may be moved to select to stay in a position from multiple options 8709, 8710, 8711. The plug switch 8708 may change electricity parameter by moving a parameter, which may be detected and used by the driver when the plug 8707 is inserted into the socket.

Figure 14:
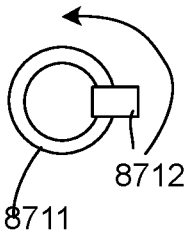
FIG. 14 shows another manual switch.

In FIG. 14, as a top view, the plug 8711 has a movable protruding block 8712 for triggering a structure setting while the plug 8711 is inserted into the socket to indicate the control circuit the working parameter.

In some embodiments, the plug has a manual switch for a user to select an option to change the working parameter.

In some embodiments, multiple plugs are provided to be selected inserting into the socket for selecting different working parameters. This is not shown because the description enables persons of this field to know that preparing multiple plugs with different structures or parameters. Users only need to select a desired plug to plug into the socket to get corresponding working parameter.

Figure 2:
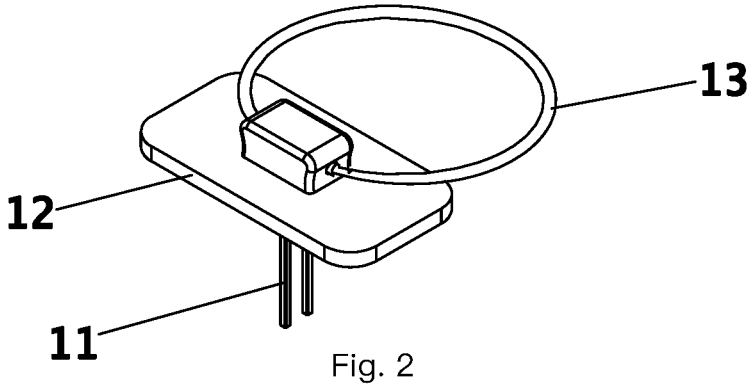
FIG. 2 shows a zoom-up view of a component of the example in FIG. 1.

In some embodiments, the plug has a pulling handle, as illustrated as a pulling ring in FIG. 2.

In FIG. 12A, the plug has a magnet unit 8713 sending a magnetic message to the socket to indicate the working parameter.

In some embodiments, the plug has a conductive unit for changing a circuit route of the driver when the plug is inserted into the socket. This may be shown in other examples shown in FIG. 1 to FIG. 9.

Figure 7:
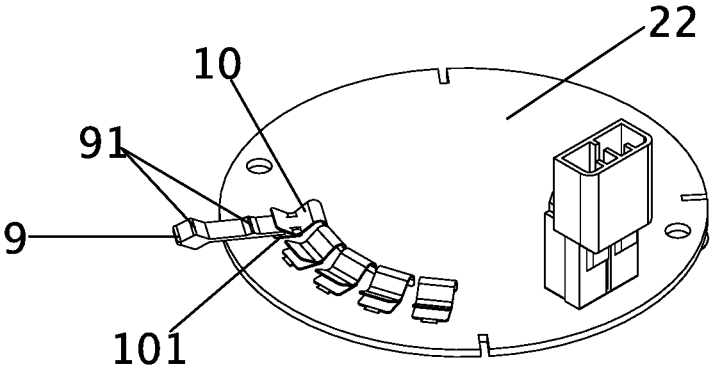
FIG. 7 shows a zoom-up view of a component in the example of FIG. 6.
Figure 8:
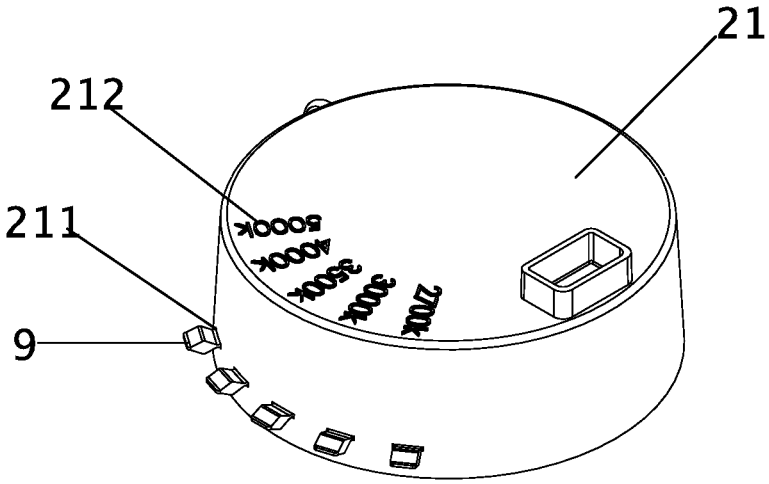
FIG. 8 shows a zoom-up view of another component in the example of FIG. 6.

In some embodiments, the plug is an elongated plate, as shown in the examples of FIG. 7 and FIG. 8.

In some embodiments, the elongated plate has a terminal to change a conductive status of a switch disposed on the socket.

In some embodiments, when the elongated plate is pulled, the working parameter is set.

Figure 15:
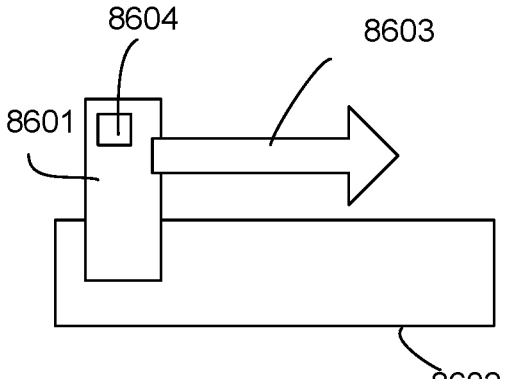
FIG. 15 shows another manual switch.

In FIG. 15, the plug 8601 is movable to change the working parameter when the plug is inserted into the socket 8602. For example, when the plug 8601 is inserted to the socket 8602, the plug 8601 may still be operated to move along the direction 8603, which may cause the changing of the working parameter.

In FIG. 15, the plug has a plug circuit 8604 to be integrated with the driver when the plug is inserted into the socket.

In some embodiments, the plug circuit works differently in response to a different socket message from the socket.

In some embodiments, the light source includes multiple LED types with multiple optical parameters. The driver controls the multiple LED types to mix a target optical parameter associated with the setting.

In some embodiments, the lighting apparatus may also include a light housing and a driver box, the light housing having a light holder and a surface rim. The light holder is mounted with the light source emitting a light from a light opening of the surface rim. The driver box stores the driver and exposing the socket on a surface.

Figure 1:
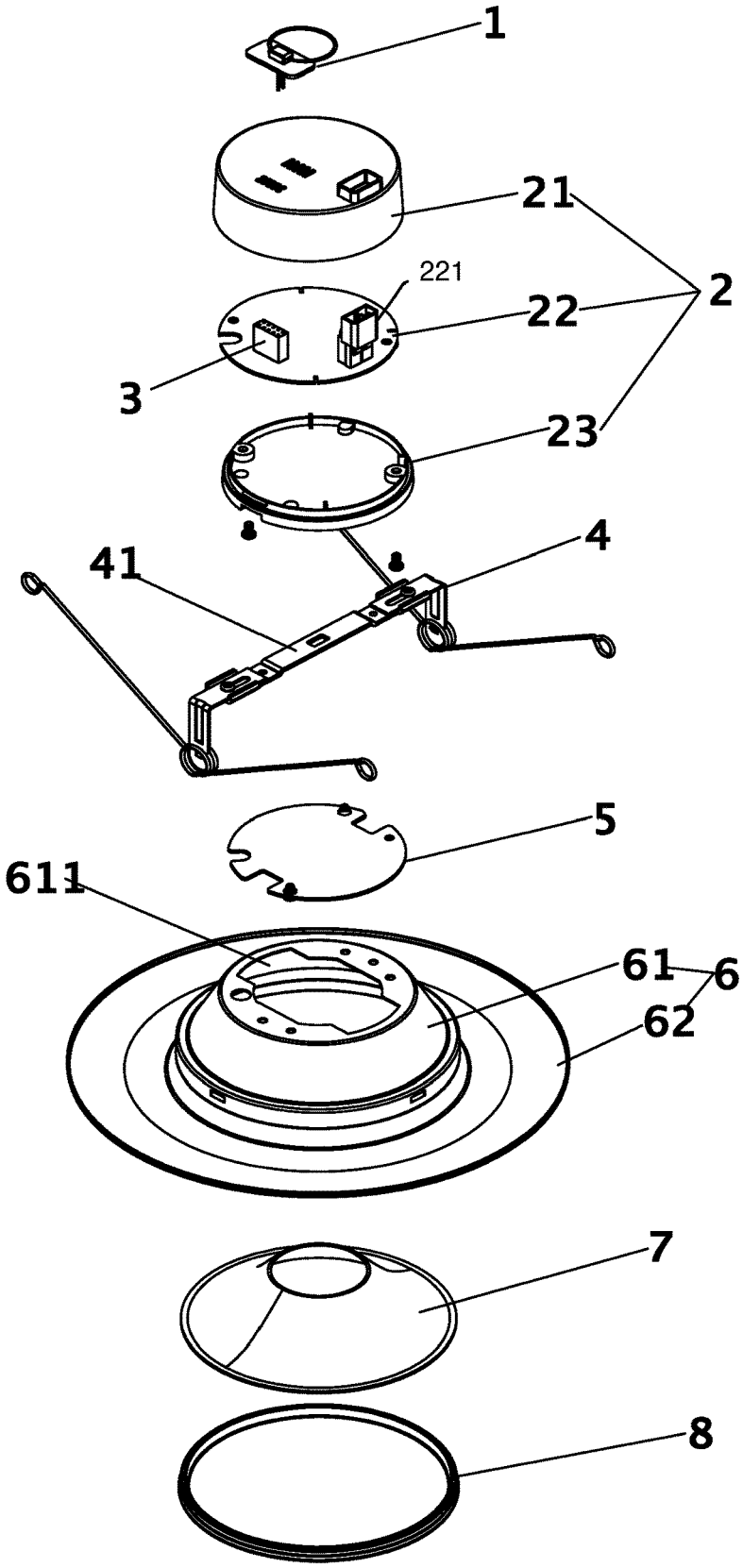
FIG. 1 shows an exploded view of a lighting apparatus.

In some embodiments, the driver box is mounted on a back side of the light holder and the driver box has an IDEAL socket for connecting to an IDEAL wire plug for receiving the external power source. A housing of the IDEAL socket 221 in FIG. 1 is directly mounted on a driver plate. The IDEAL wire plug is a popular and well-known plug structure used for connecting wires. But, the IDEAL socket is not designed to be directly placed on the driver plate. Instead, the IEDAL socket mentioned here is made as an independent wire plug. With such design, the cost is further reduced while keeping a great compliance of known technology, thus bringing unexpected result.

Please refer to FIG. 1, which illustrates a lighting apparatus embodiment. In FIG. 1, a manual switch 1 is plugged to a slot of a driver box 21 for connecting a switch unit 3 for indicating a driver module 22 to function differently in response to the plugging angle, position, whether plugged or not. The driver box 21 also has a connector 221 compatible with standard IDEAL connector interface but half of the connector 221 is embedded directly on the driver module 22 for receiving an external power for the driver module 22 to convert the external power. There is a bottom cover 23 for connecting to the driver box 21 to form a driver unit 2.

There is a U shape bar 4 with two hanging springs for fixing the lighting apparatus of FIG. 1 to a ceiling. There is a middle part 41 of the U shape bar 4 for fixing between a light source plate 5 and the bottom cover 23.

In such design, the light source plate 5 is mounted with multiple LED modules and emit light to a light opening 611 defined by a dome housing 6 with a lateral wall 61 and a surface rim 62.

There is a reflective cup 7 installed inside the lateral wall 61 for further reflecting light efficiently. A diffusion cover 8 is disposed for diffusing light of the LED modules.

Figure 3:
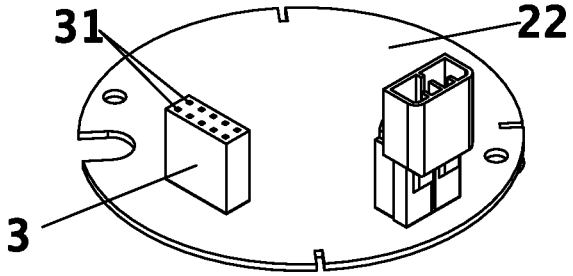
FIG. 3 shows a zoom-up view of another component of the example in FIG. 1.

Please refer to FIG. 2 and FIG. 3, which illustrates a zoom-up view of the manual switch. The manual switch has a pull ring 13 for user's finger to insert and to pull the manual switch. There is a top plate 12 for controlling inserting depth of the manual switch. There are two pins 11 for inserting into a switch unit 3 of a driver module 22. There are multiple holes 31 as multiple options on the switch unit 3. Different holes 31 correspond to different electronic settings for a driver circuit of the driver module 22 to function differently.

Therefore, when users plug the two pins 11 of the manual switch to different holes of the switch unit 3, a setting is selected and the driver circuit detects which holes users are plugged with the manual switch and function correspondingly. There are various ways for implementing the detection scheme of the driver circuit. For example, the two pins 11 are metal pins and when plugging into the switch unit 3, the two pins 11 form a close loop in the driver module 22 corresponding to a setting.

Figure 4:
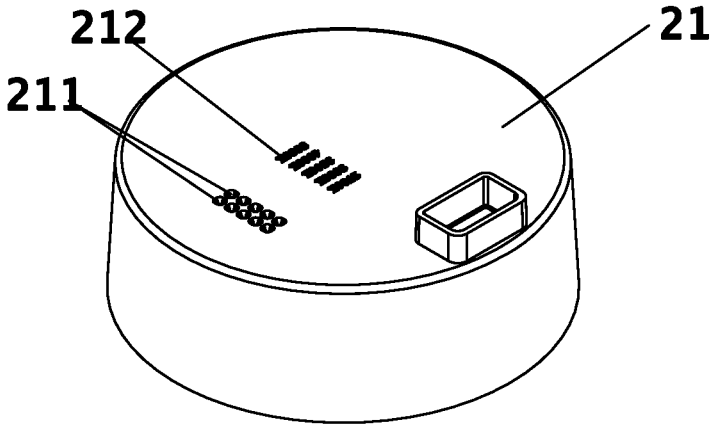
FIG. 4 shows a zoom-up view of another component of the example in FIG. 1.

Please refer to FIG. 4. The driver box 21 has several slot openings 212 for corresponding to different holes 31 in FIG. 3. There are labels 212 printed on the surface of the driver box 21 for guiding users to select needed settings.

Figure 5:
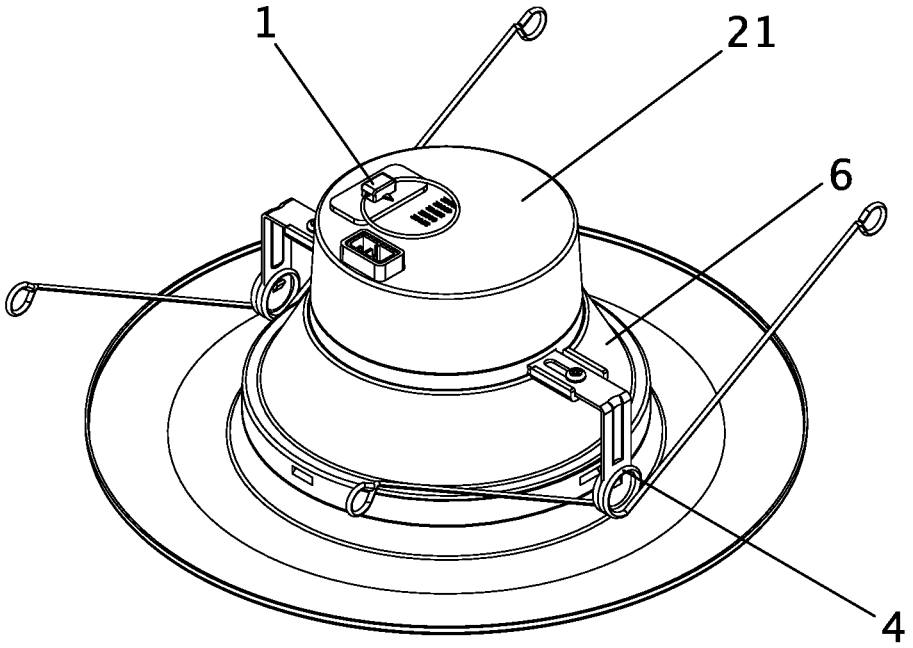
FIG. 5 shows an assembled lighting apparatus.

Please refer to FIG. 5, which show an assembled example of the embodiment mentioned above. The manual switch 1 is plugged into the hole of the switch unit in FIG. 5 via slot opening on the driver box 21. The dome housing is attached to driver box 21. The U shape bar 4 mentioned above is clipped between the driver box 21 and the dome housing 6.

Such design makes assembling of the lighting apparatus more conveniently.

Figure 6:
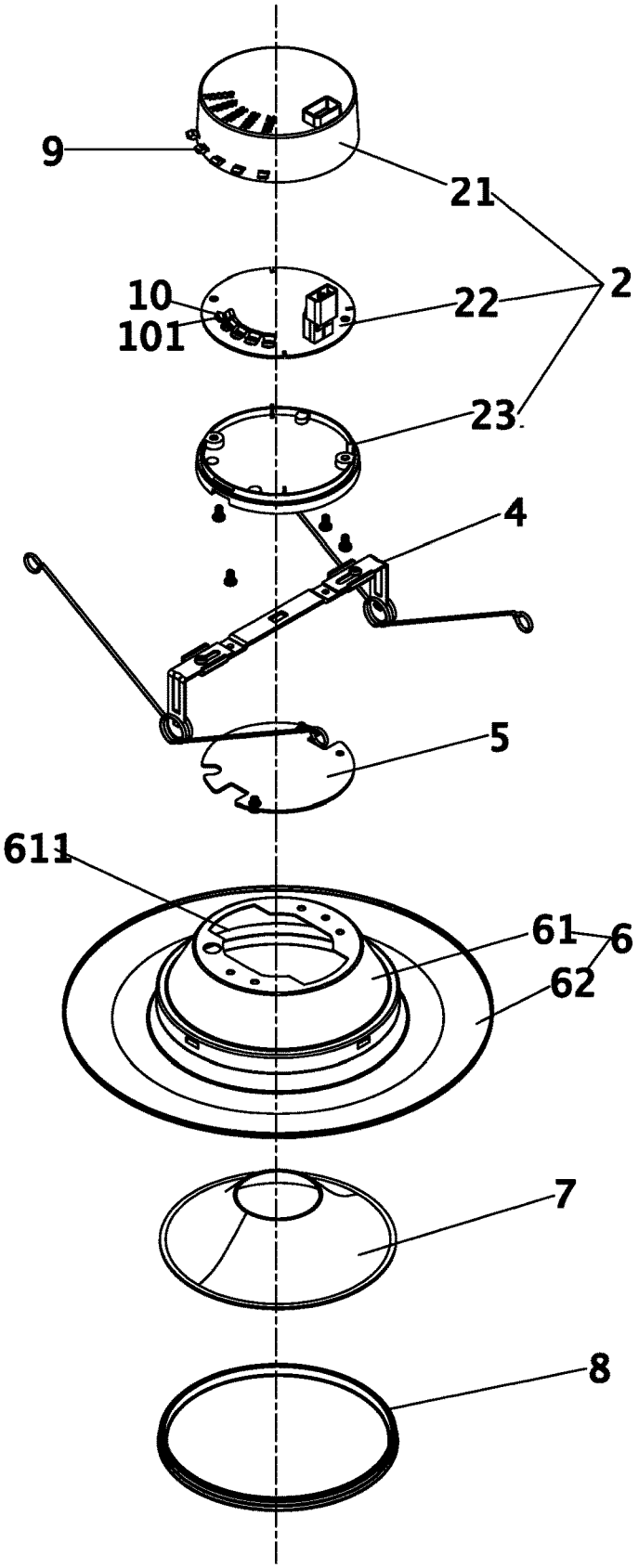
FIG. 6 shows an exploded view of another lighting apparatus.

Please refer to FIG. 6, which shows a modified embodiment based on the example of FIG. 1. The same reference to the example of FIG. 1 to FIG. 5 refer to the same components and are not repeated for brevity.

Unlike the example of FIG. 1 to FIG. 5, the switch unit 10 has multiple sub-units.

Please refer to FIG. 7, which is a zoom-up view of the switch units on the driver module 22. In this example, the manual switch 9 has two ends 91, with one end inserted to a receiver end 101 of the switch unit 10.

In FIG. 7, there are multiple receiver ends 101 corresponding to different settings respectively. When the manual switch 9 is inserted to one receiver 101, a setting is selected to indicate the driver circuit of the driver module 22 to function accordingly.

Please refer to FIG. 8. The driver box 21 also has labels 212 indicating users which position corresponding to an associated setting, like a color temperature. There are multiple slot openings 211 on a lateral side of the driver box 21 for inserting the manual switch 9.

Figure 9:
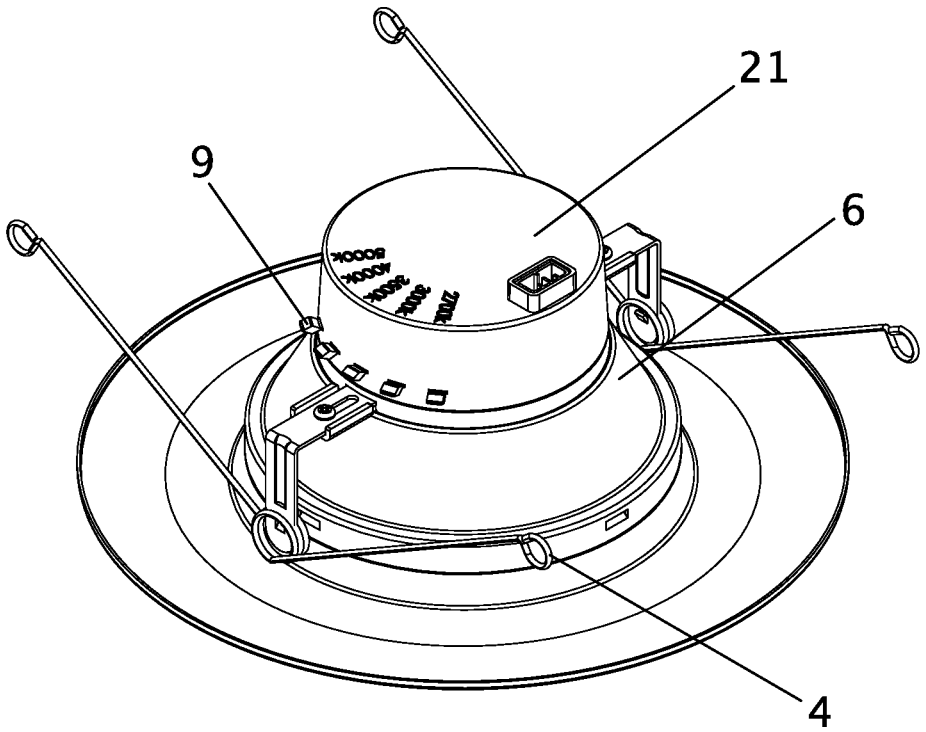
FIG. 9 shows an assembled lighting apparatus.

Please refer to FIG. 9, which shows an assembled example of the example mentioned above. The same reference numerals refer to the same components and are not repeated here for brevity.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A lighting apparatus comprising:

a light source comprising multiple LED modules;

a driver comprising a converter circuit and a control circuit, the converter circuit converting an external power source to a driving current supplied to the light source; and a manual switch comprising a socket and a plug for a user to insert the plug into the socket for selecting a working parameter, the manual switch being connected to the driver and the control circuit of the driver controlling the light source according to the working parameter.

2. The lighting apparatus of claim 1, wherein multiple inserting angles of the plug with respect to the socket correspond to multiple working parameters.

3. The lighting apparatus of claim 2, wherein a first inserting angle of the plug with respect to the socket activates a function of the driver and a second inserting angle of the plug with respect to the socket deactivates the function of the driver, the plug is still inserted to the socket to prevent dust.

4. The lighting apparatus of claim 1, wherein multiple inserting depths of the plug into the socket correspond to multiple working parameters.

5. The lighting apparatus of claim 1, wherein the plug has a configurable setting for changing the working parameter.

6. The lighting apparatus of claim 5, wherein the plug has a movable protruding block for triggering a structure setting while the plug is inserted into the socket to indicate the control circuit the working parameter.

7. The lighting apparatus of claim 5, wherein the plug has a plug switch for a user to select an option to change the working parameter.

8. The lighting apparatus of claim 1, wherein multiple plugs are provided to be selected inserting into the socket for selecting different working parameters.

9. The lighting apparatus of claim 1, wherein the plug has a pulling handle.

10. The lighting apparatus of claim 1, wherein the plug has a magnet unit sending a magnetic message to the socket to indicate the working parameter.

11. The lighting apparatus of claim 1, wherein the plug has a conductive unit for changing a circuit route of the driver when the plug is inserted into the socket.

12. The lighting apparatus of claim 1, wherein the plug is an elongated plate.

13. The lighting apparatus of claim 12, wherein the elongated plate has a terminal to change a conductive status of a switch disposed on the socket.

14. The lighting apparatus of claim 13, wherein when the elongated plate is pulled, the working parameter is set.

15. The lighting apparatus of claim 1, wherein the plug is movable to change the working parameter when the plug is inserted into the socket.

16. The lighting apparatus of claim 1, wherein the plug has a plug circuit to be integrated with the driver when the plug is inserted into the socket.

17. The lighting apparatus of claim 16, wherein the plug circuit works differently in response to a different socket message from the socket.

18. The lighting apparatus of claim 1, wherein the light source comprises multiple LED types with multiple optical parameters, the driver controls the multiple LED types to mix a target optical parameter associated with a setting.

19. The lighting apparatus of claim 1, further comprising a light housing and a driver box, the light housing having a light holder and a surface rim, the light holder being mounted with the light source emitting a light from a light opening of the surface rim, the driver box storing the driver and exposing the socket on a surface.

* * * * *